US007455259B2

(12) United States Patent
Koutonen et al.

(10) Patent No.: US 7,455,259 B2
(45) Date of Patent: Nov. 25, 2008

(54) METHOD FOR CONTROLLING THE STRUCTURE OF A FIBROUS WEB ROLL, FOR EXAMPLE, A PAPER OR BOARD ROLL

(75) Inventors: Pauli Koutonen, Jokela (FI); Marko Jorkama, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 338 days.

(21) Appl. No.: 10/517,893

(22) PCT Filed: Jun. 10, 2003

(86) PCT No.: PCT/FI03/00456

§ 371 (c)(1),
(2), (4) Date: Jan. 28, 2005

(87) PCT Pub. No.: WO03/106313

PCT Pub. Date: Dec. 24, 2003

(65) Prior Publication Data

US 2005/0167063 A1 Aug. 4, 2005

(30) Foreign Application Priority Data

Jun. 14, 2002 (FI) ..... 20021154

(51) Int. Cl.
*B65H 18/14* (2006.01)

(52) U.S. Cl. ..... 242/541; 242/542; 242/542.2

(58) Field of Classification Search ..... 242/534, 242/541, 542, 542.2, 542.4
See application file for complete search history.

(56) References Cited

U.S. PATENT DOCUMENTS 3,405,855 A 10/1968 Daly et al.
3,430,880 A * 3/1969 Armelin et al. ..... 242/527.7
4,199,117 A * 4/1980 Muller et al. ..... 242/419.5
4,274,604 A 6/1981 Vetterli
4,463,586 A * 8/1984 Griffin ..... 72/11.7
4,465,243 A * 8/1984 Welp ..... 242/541.4
4,524,919 A * 6/1985 Wehrmann ..... 242/533.5
4,598,877 A 7/1986 Oinonen
4,817,883 A * 4/1989 Hoffmann et al. ..... 242/534
5,335,871 A 8/1994 Fissmann et al.
5,562,261 A 10/1996 Beisswanger et al.

(Continued)

FOREIGN PATENT DOCUMENTS

JP 9-315632 A 12/1997

(Continued)

OTHER PUBLICATIONS

Search Report issued in Finnish Patent Application 20021154.

(Continued)

*Primary Examiner*—Sang Kim
(74) *Attorney, Agent, or Firm*—Stiennon & Stiennon

(57) ABSTRACT

The structure of a fibrous web roll is controlled by winding a fibrous web (W) into a fibrous web roll (15) through a winding nip (N) between the fibrous web roll (15) being formed and a winding drum (13). The structure of the fibrous web roll (15) being formed is controlled by regulating the direction of passing the web to a windup, thereby regulating the wrap angle.

16 Claims, 4 Drawing Sheets

U.S. PATENT DOCUMENTS

| | | | | |
|---|---|---|---|---|
| 5,758,842 | A | 6/1998 | Dorfel et al. | |
| 6,089,496 | A * | 7/2000 | Dorfel | 242/541.5 |
| 6,427,939 | B1 * | 8/2002 | Miyata et al. | 242/534.2 |

FOREIGN PATENT DOCUMENTS

| | | | |
|---|---|---|---|
| WO | WO 03/106313 | A1 | 12/2003 |

OTHER PUBLICATIONS

International Search Report issued in PCT/FI03/00456.
International Preliminary Examination Report issued in PCT/FI03/00456.
Winding Theory, Kenneth G. Frye, p. 13, Fig. 17, Tappi Press, 1990.
Winding Theory, Kenneth G. Frye, pp. 15-17, Figs. 25 & 26, Tappi Press, 1990.

* cited by examiner

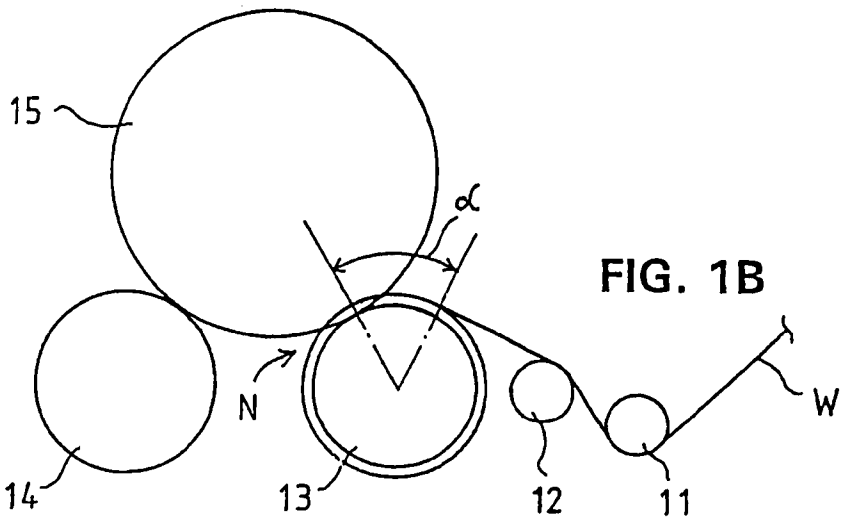
FIG. 1A
FIG. 1B
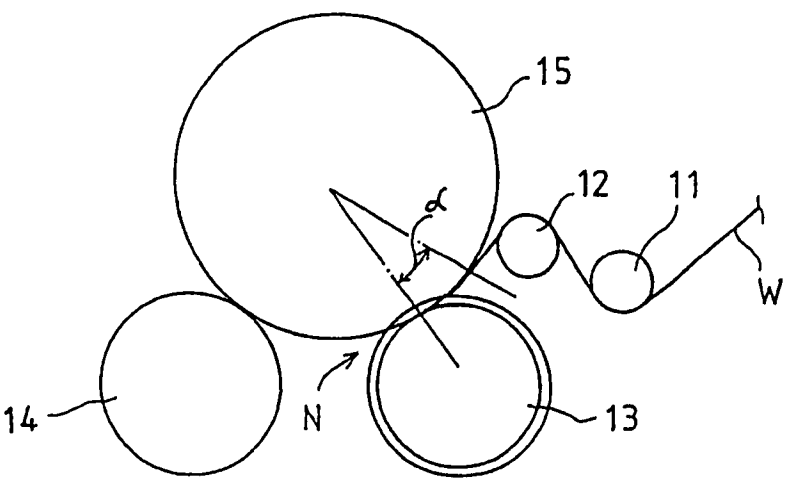
FIG. 1C
FIG. 1D

METHOD FOR CONTROLLING THE STRUCTURE OF A FIBROUS WEB ROLL, FOR EXAMPLE, A PAPER OR BOARD ROLL

CROSS REFERENCES TO RELATED APPLICATIONS

This application is a U.S. national stage application of International App. No. PCT/FI03/00456, filed Jun. 10, 2003, the disclosure of which is incorporated by reference herein, and claims priority on Finnish Application No. 20021154, filed Jun. 14, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

As known in the state of the art, a fibrous web is wound into rolls by means of many different types of winders, for example, two-drum winders, in which a fibrous web is wound into a roll, while supported on two winding drums, through a nip between one winding drum and a fibrous web that is being formed. The web can be passed to the two-drum winder either from above, i.e. from above the winding drum to the nip between the winding drum and the fibrous web roll forming the winding nip, or from below, so that the web is passed from below the winding drum to the winding nip between the winding drum and the fibrous web roll that is being formed.

Primarily three types of two-drum winders are known from the state of the art: winders having winding drums which are hard, steel surfaced; winders in which the rear winding drum or both winding drums are soft surfaced, for example, rubber surfaced; and the winder marketed by the Metso Paper, Inc. under the trademark WinBelt®, in which a belt arrangement disposed around two guide rolls is used as a winding drum.

In winding, for example, center winding is also used in which the web roll that is building up is supported at its center, and the fibrous web is wound into a web roll through a nip between a winding drum and the web roll being formed.

As known from the state of the art, when controlling the structure of a fibrous web roll, above all its hardness, it has been affected, among other things, by changing the tension of the web being wound, by regulating the torque differential between the winding drums in a two-drum winder and by regulating center drive or surface traction in a center winder. In addition, the structure of the fibrous web roll has been affected by means of friction, for example, by selection of the winding drum coating.

It has been possible to wind rolls of a slightly larger diameter on prior-art two-drum winders that use a soft surface drum as one or both winding drums as compared with two-drum winders that use hard winding drums with a steel surface, because a soft surface tightens the roll more than a hard surface without giving rise to winding defects. However, when using soft surface winding drums, one problem can be that the soft surface may have tightened the roll even too much.

When a soft surface drum is used in winding, the tightening effect of the nip on the web increases, with the result that it may become a problem that the tightening effect increases too much, so that the roll becomes too tight and the surface sheets of the roll may break on a conveyor or during transport.

In the applications known today, the radial distribution of tension inside a roll in the running direction of the web is controlled by means of three winding parameters (Kenneth G. Frye, Winding, p. 13, FIG. 17, Tappi Press, 1990):

1. Regulating the tension of the web being wound just before a windup.
2. Regulating winding force. The winding force is the tightening of the sheet caused by torque differential in the outermost layer of the roll.
3. Regulating the radial nip load in the nips acting in connection with winding, for example, roll, winding drum, rider roll nips, and the like.

In brief, it may be stated that due to the effect of winding parameters the tension of the web just before a windup changes into wound-on-tension WOT (Wound-On-Tension i.e. the machine direction tension of the web in the outermost layer of the web roll that is building up). This wound-on-tension determines the internal tension distribution of the roll being formed.

Because of the physical limitations of the value ranges of the above-mentioned winding parameters, in windups it often becomes necessary to strengthen or weaken the WOT value attainable by the winding parameters.

In other words, the three winding parameters described above have physical limitations setting limits to where their effect can be used. Additional control possibilities are needed for control of the roll structure.

Furthermore, when using a center winder, in some situations there is a need to regulate separately one component-web winding process at a particular station, in which connection there is a need to find a larger range of regulation for this winding operation while not touching the control parameters of the other component-web winding parameters.

SUMMARY OF THE INVENTION

An object of the invention is to provide further possibilities for control of the structure of a fibrous web roll.

An object of the invention is also to provide a fourth winding parameter.

In this invention, the inventors have realized the possibility of using the direction of passing a web into a windup, for example, a two-drum winder, a machine winder or a center winder, as a fourth winding parameter. The invention can be applied particularly usefully when the winding drum is covered with an almost incompressible "soft" cover. By "soft" is meant in this connection a cover whose deformations in the nip are of the same order than those of the wound roll.

In accordance with an advantageous application of the invention, the structure of a fibrous web roll being formed is affected by means of a fourth winding parameter, the direction of passing the web into a winder, by regulating the wrap angle, or the angle which is covered by the fibrous web when it travels on a winding drum, i.e. on the drum that forms a winding nip with the web roll that is building up, before it enters the winding nip. The tightness of winding is controlled during running by regulating the wrap angle. The effect of the wrap angle regulation on the structure of the web roll being formed depends on the properties of the fibrous web and on the roll covers used, such as, for example, hard rolls and soft cover rolls, in which in particular, in addition to softness, the Poisson ratio of the cover is of significance.

Thus, the fourth winding parameter according to the invention can be used very usefully in a two-drum winder having a soft rubber-like rear drum. In that case, by making the wrap angle smaller it is possible to prevent large-diameter rolls from becoming too hard at the surface, which is a problem in the state of the art. In practice, this wrap angle as a function of the roll diameter is determined experimentally, i.e. a certain wrap angle function is set in the control system of the slitter-winder and the hardness distribution of rolls is measured. The wrap angle function is changed until the desired roll structure is achieved. This hardness regulation of a set can also be carried out for a particular station or roll, if the wrap angle of the component webs can be controlled.

The fourth winding parameter used in connection with the invention also enables partial control of some other force quantities, in addition to WOT. As an example may be mentioned the tangential loads of the winding nip, which loads on certain fibrous webs significantly contribute to the creation of J-lines, which J-lines represent winding defects caused by slippage between winding layers (Kenneth G. Frye, Winding, p. 15, FIGS. 25 & 26, Tappi Press, 1990).

Thus, the control principle in accordance with the invention can be used in different e.g. two-drum and center winders, among other things, in slitter-winders and particularly appropriately in two-drum winders provided with soft cover winding drums.

In accordance with the invention, the wrap angle curve, or wrap angle, as a function of the roll diameter is changed, when needed, after each set change such that the desired roll structure is achieved. When using a determination based on wrap angle, the tighter, or the harder, the roll that is desired to be produced, the larger the wrap angle that is selected while the other parameters affecting the structure of the roll remain unchanged.

In the following, the invention will be described in greater detail with reference to the figures in the appended drawing.

BRIEF DESCRIPTION OF THE DRAWINGS

FIGS. 1A-1D schematically show one application of the invention in a two-drum winder when the web is passed from above during winding.

DESCRIPTION OF THE PREFERRED EMBODIMENTS

FIGS. 1A-1D schematically show winding on a two-drum winder in which a fibrous web roll 15, for example a paper or board roll, being formed is supported by winding drums 13, 14 and winding takes place through a winding nip N between one winding drum 13 and the fibrous web roll 15 being formed. A fibrous paper or board web W is passed into the winding nip N via guide rolls 11 and 12. In accordance with the invention, the structure of the roll 15 being formed is controlled by changing the magnitude of the wrap angle α by changing the location of the guide rolls 11, 12 with respect to the winding drum 13 such that the wrap angle changes.

A positive large wrap angle α has been used in FIG. 1A, a positive small wrap angle α has been used in FIG. 1B, a zero angle α has been used in FIG. 1C, and a negative wrap angle α as been used in FIG. 1D.

Figure 2B:
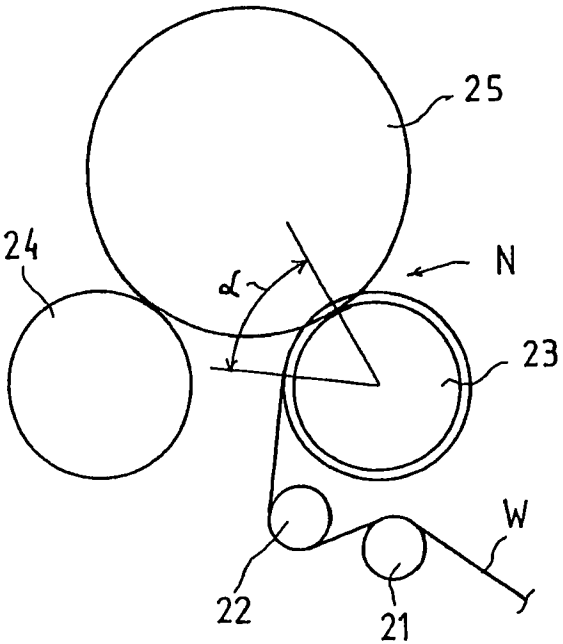
FIGS. 2A-2C schematically show one application of the invention in a two-drum winder when the web is passed from below during winding.
Figure 2A:
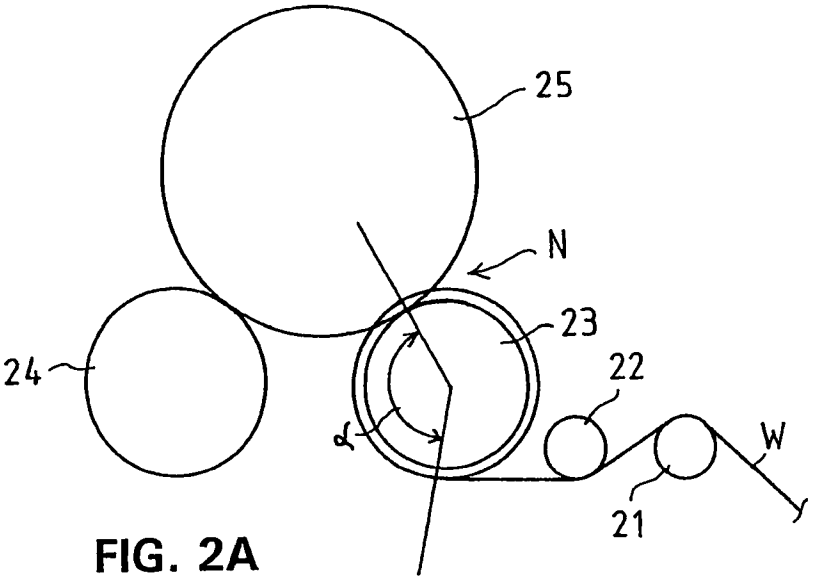
Figure 2C:
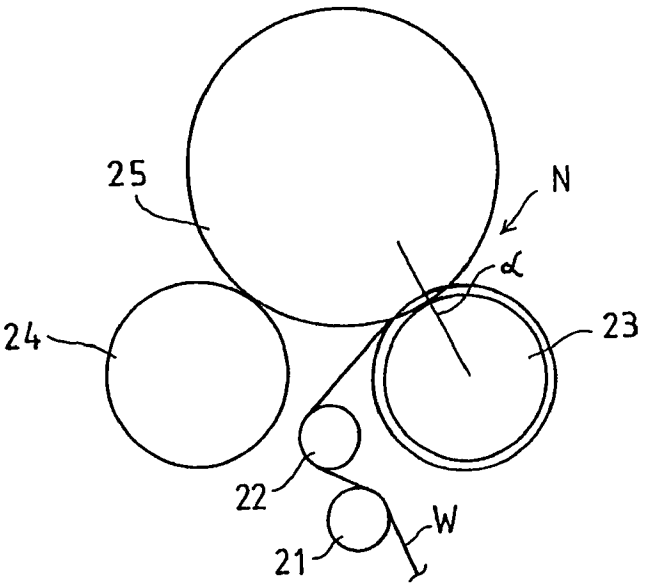

FIGS. 2A-2C illustrate an application of the invention in a two-drum winder in which a web is passed from below and in which the fibrous web W is passed via guide rolls 21, 22 into a winding nip N from below a winding drum 23 forming the winding nip N with a fibrous web roll. A second winding drum, which supports the roll 25 being formed, has been designated by the reference numeral 24. The wrap angle α is regulated by changing the location of the guide rolls 21, 22 with respect to the winding drum 23 forming the winding nip N such that the angle α through which the web W travels on the winding drum 23 before entering the winding nip N, changes as desired.

In FIG. 2A there is a positive large wrap angle α, in FIG. 2B there is a positive small wrap angle α, and a zero angle α has been used in FIG. 2C.

FIGS. 3A-3D are schematic views of an application of the invention in center winding, in which a fibrous web roll 35 being formed is supported at its center and the winding takes place through a winding nip N between the roll 35 being formed and a winding drum 33. A fibrous web W is passed to the winding drum 33 via a guide roll 31. The wrap angle α is changed by moving the position of the guide roll 31 with respect to the winding drum 33 such that the angle through which the web W travels on the winding drum 33 before entering the winding nip N, changes as desired.

Figure 3B:
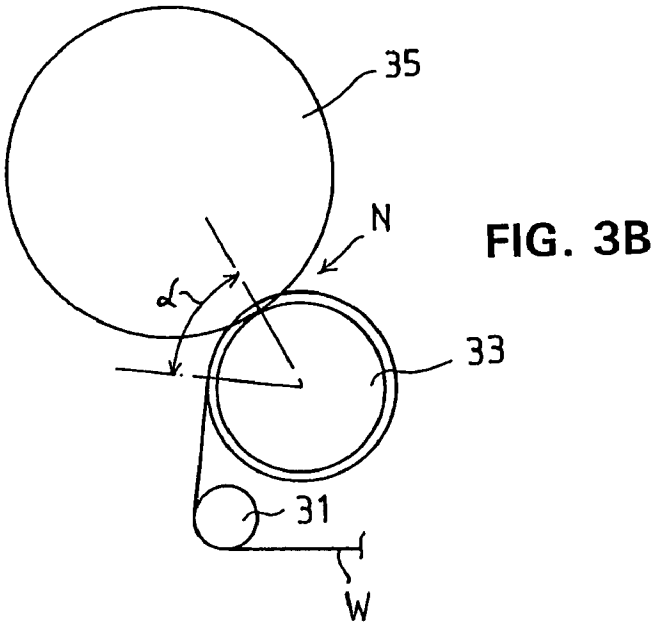
FIGS. 3A-3D schematically show one application of the invention in center winding.
Figure 3D:
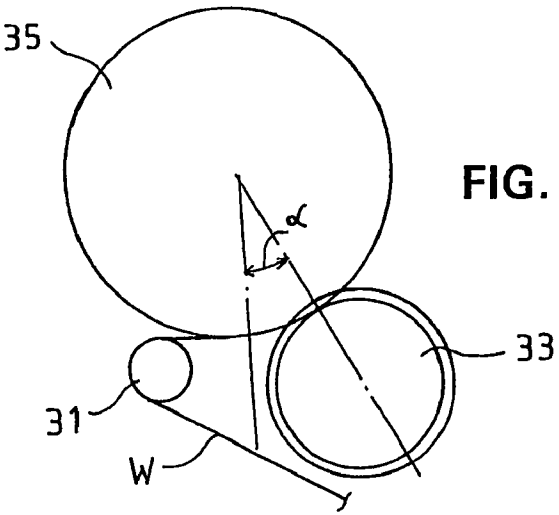
Figure 3A:
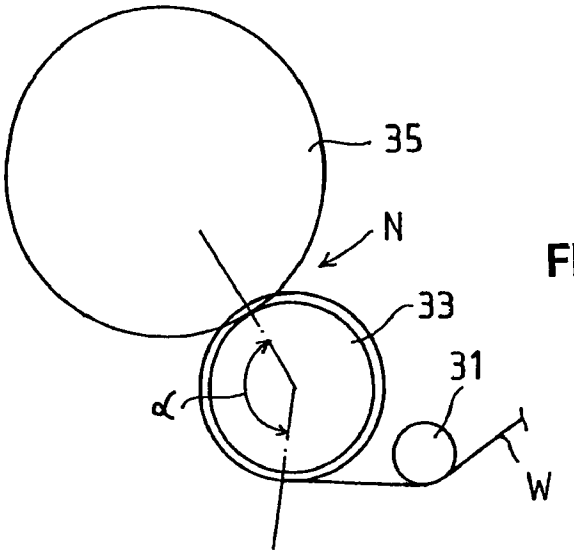
Figure 3C:
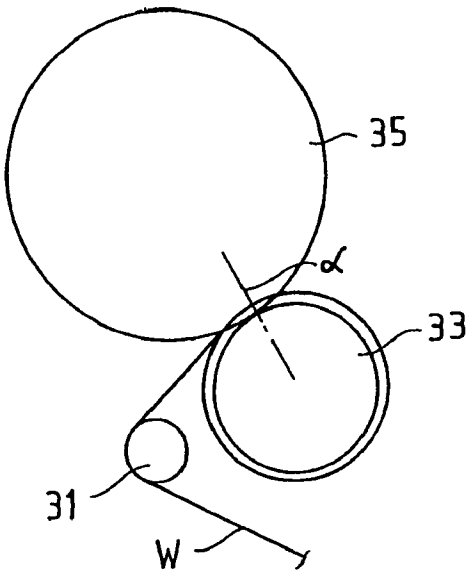

In FIG. 3A there is a positive large wrap angle α, in FIG. 3B there is a positive small wrap angle α, in FIG. 3C there is a zero angle α, and in FIG. 3D there is a negative wrap angle α.

Figure 4:
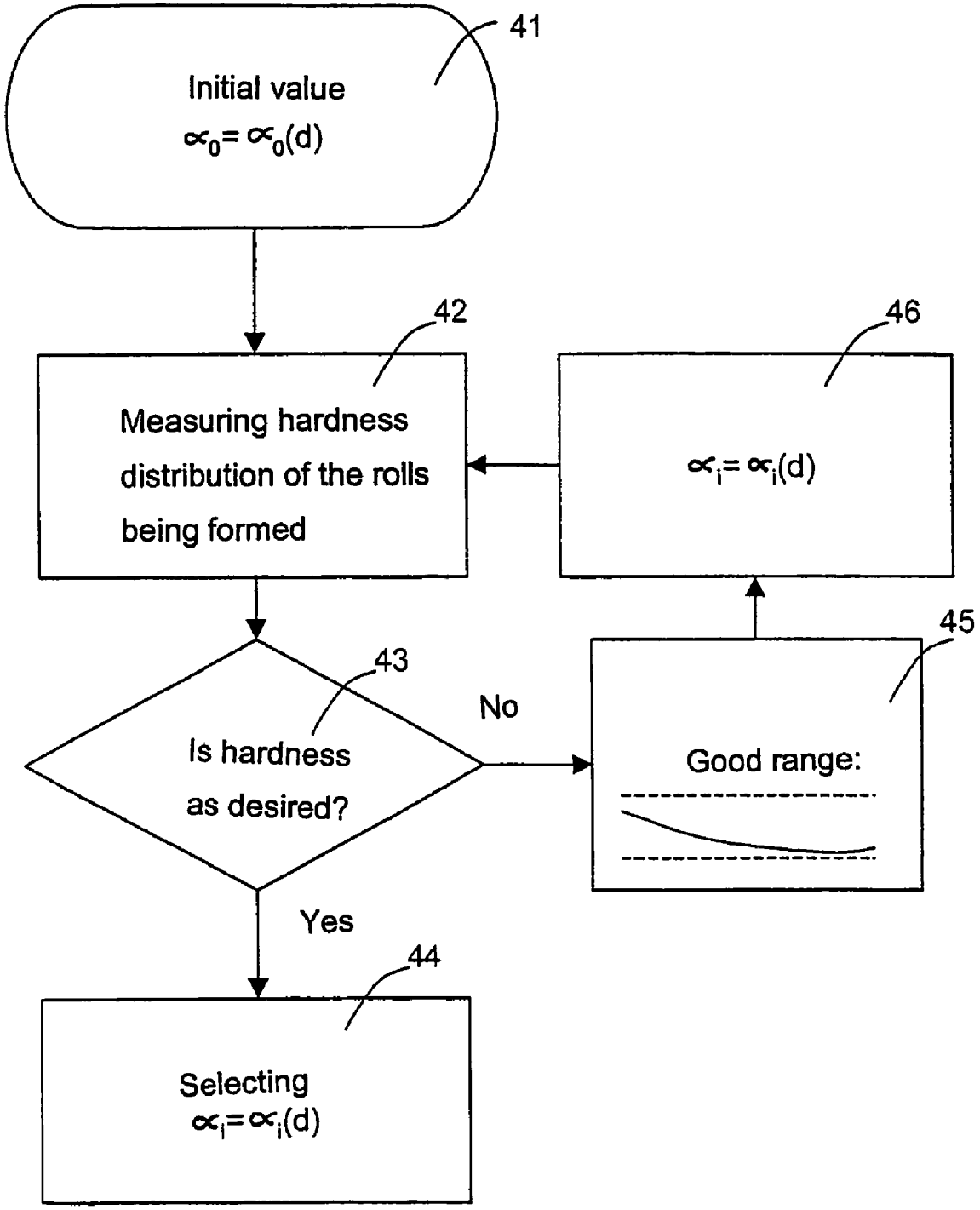
FIG. 4 schematically shows a block diagram associated with the arrangement in accordance with the invention.

In accordance with the schematic block diagram illustration of FIG. 4, when the first set is wound, the wrap angle is selected according to the equation $\alpha_0=\alpha_0(d)$, block 41, for example, depending on the paper grade based on experience. After the winding, the hardness distribution of the rolls being formed is measured, as shown in block 42. Examination of the hardness distribution is carried out in block 43, if the hardness distribution is desired, i.e. in a good range, which is schematically indicated, for example, in block 45, and the wrap angle is selected according to the first winding in block 44 such that $\alpha_i=\alpha_i(d)$ (i=0). If the hardness distribution achieved in the first set is not as desired, a change of the wrap angle is performed and a new wrap angle is determined as a function of the hardness distribution in block 46 and in this way attempts are made to determine experimentally such a wrap angle that a desired hardness distribution is achieved for the rolls.

If it is possible to measure WOT in the slitter during running, the wrap angle can be controlled by a closed control loop, in which the reference $WOT_{ref}=WOT_{ref}(d)$ is given and the wrap angle is regulated based on the measurement of WOT.

Above, the invention has been described with reference to some of its advantageous exemplifying applications only, but the invention is not by any means meant to be narrowly limited to the details of them.

The invention claimed is:

1. A method for winding a paper or board web into a web roll of a selected roll hardness distribution, comprising the steps of:

winding a paper or board web into a first web roll by leading the web through a winding nip defined between said web roll and a winding drum, the web defining a wrap angle as it passes through the nip, the wrap angle being the amount the web wraps the winding drum before entering the nip when the wrap angle is positive, or the amount the web wraps the web roll before entering the nip when the wrap angle is negative, the winding being performed with the wrap angle regulated according to a first wrap angle function with respect to the diameter of the web roll;

measuring a hardness distribution of the first web roll; and in response to the measured hardness distribution, winding the paper or board web into a second web roll, the winding being performed with the wrap angle regulated according to a second wrap angle function with respect to the diameter of the web roll, the second wrap angle function being different than the first wrap angle function, and repeating the measurement of the hardness distribution and adjustment of wrap angle function until the selected roll hardness distribution is achieved.

2. The method of claim 1, wherein the web passes to the winding drum over at least one guide roll, and wherein each step of regulating the wrap angle comprises the step of moving the position of the at least one guide roll with respect to the winding drum.

3. The method of claim 1 wherein the wrap angle is regulated when there is slippage between the paper or board web and the winding drum.

4. The method of claim 1 wherein the method comprises winding a plurality of web rolls in sequence, and wherein the method is employed with each said winding.

5. The method of claim 1 wherein the method is used with at least one other control mode affecting the structure of the web roll, in which method the structure of the web roll being formed is controlled by regulating one or more of the following factors:

the tension of the web before a windup;

winding force; and radial nip load in nips through which the web passes.

6. The method of claim 1 wherein the step of winding according to the first or second wrap angle function comprises making the wrap angle larger to increase the roll hardness.

7. The method of claim 1 wherein the step of winding according to the first or second wrap angle function comprises making the wrap angle smaller to provide a softer web roll.

8. The method of claim 1 wherein the step of measuring the web roll hardness distribution comprises measuring the wound-on-tension in a slitter during running, and the changing of the wrap angle is controlled by a closed control loop, in response to the measured wound-on-tension.

9. A method for winding a paper or board web into a web roll of a selected web hardness distribution, the web passing over at least one guide roll of an apparatus to a nip defined between the web roll and a winding drum, the position of the at least one guide roll being adjustable with respect to the winding drum to adjust the wrap angle of the web as it approaches the nip, the wrap angle being the amount the web wraps the web roll or the winding drum before reaching the nip, the method comprising the steps of:

winding the paper or board web into a first roll in the apparatus while regulating the wrap angle with respect to roll diameter according to a first wrap angle function;

measuring the first roll hardness distribution;

if the measured first roll hardness distribution is the selected web hardness distribution, winding the paper or board web into a second roll while regulating the wrap angle with respect to roll diameter according to the first wrap angle function, and if the measured roll hardness distribution is not the selected web hardness distribution winding the paper or board web into a second roll in the apparatus while regulating the wrap angle according to a second wrap angle function which is different than the first wrap angle function, and repeating the winding of rolls, the measuring of the roll hardness distribution, and the changing of wrap angle function until the selected hardness distribution is obtained.

10. The method of claim 9 wherein the step of regulating the wrap angle with respect to roll diameter comprises increasing the wrap angle.

11. The method of claim 9 wherein the step of regulating the wrap angle with respect to roll diameter comprises decreasing the wrap angle.

12. The method of claim 9 wherein the structure of the roll being formed is controlled by regulating one or more of the following factors:

the tension of the web before a windup;

winding force; and radial nip load in nips through which the web passes.

13. In a method for controlling the structure of a paper or board web roll, in which a paper or board web is wound into a paper or board web roll through a winding nip between the paper or board web roll and a winding drum, the web defining a wrap angle as it passes through the nip, the wrap angle being the amount the web wraps the winding drum before entering the nip when the wrap angle is positive, or the amount the web wraps the web roll before entering the nip when the wrap angle is negative, the improvement comprising controlling the structure of the web roll being formed by adjusting the wrap angle of the web as it passes through the nip during the course of winding the web roll to obtain a desired roll hardness distribution.

14. The method of claim 13 further comprising a step of measuring the wound-on-tension in a slitter during running, and the step of regulating the wrap angle comprises changing of the wrap angle by a closed control loop, in response to the measured wound-on-tension to thereby wind the paper or board web roll to a desired roll hardness distribution.

15. The method of claim 13 wherein the step of adjusting the wrap angle of the web as it passes through the nip during the course of winding the web roll comprises making the wrap angle larger to provide a harder web roll.

16. The method of claim 13 wherein the step of adjusting the wrap angle of the web as it passes through the nip during the course of winding the web roll comprises making the wrap angle smaller to provide a softer web roll.

* * * * *